US005940670A

United States Patent [19]

Hamada

[11] Patent Number: 5,940,670

[45] Date of Patent: Aug. 17, 1999

[54] TRANSFER DEVICE

[75] Inventor: Futoshi Hamada, Toyokawa, Japan

[73] Assignee: Minolta Co., Ltd., Osaka, Japan

[21] Appl. No.: 08/887,290

[22] Filed: Jul. 2, 1997

[30] Foreign Application Priority Data

Jul. 3, 1996 [JP] Japan ..... 8-173362

[51] Int. Cl.[6] ..... G03G 15/01

[52] U.S. Cl. ..... 399/303

[58] Field of Search ..... 399/304, 303

[56] References Cited

U.S. PATENT DOCUMENTS 5,132,737 7/1992 Takeda et al. ..... 399/366
5,172,172 12/1992 Amemiya et al. ..... 399/303
5,239,347 8/1993 Onodera et al. ..... 399/304
5,249,023 9/1993 Miyashiro et al. ..... 399/303

*Primary Examiner*—William Royer
*Attorney, Agent, or Firm*—McDermott, Will & Emery

[57] ABSTRACT

A transfer device according to the present invention is comprised of a transfer material carrying member such as paper, a transfer charger provided in the transfer material carrying member, and an opposite member comprising elastic material opposite to the transfer member. The opposite member is movable to both a contact position with the surface of the transfer material carrying member and a separate position away from the surface of the transfer material carrying member. When the transfer material positions at the adsorption position, the opposite member is switched to move to the contact position from the separate position to carry a transfer material thereon. After the transfer material is carried, the transfer material is adsorbed on the surface of the transfer material carrying member.

20 Claims, 3 Drawing Sheets

TRANSFER DEVICE

BACKGROUND OF THE INVENTION

1. Field of the Invention

The present invention relates to a transfer device for allowing a transfer material such as paper to be electrostatically adsorbed onto a transfer material carrying member, conveying the transfer material and transferring an image to the transfer material.

2. Description of the Related Art

Conventionally, a color copying machine with a transfer device is known in U.S. Pat. No. 5,132,737. The transfer device is comprised of a transfer drum with a carrying sheet for carrying a transfer material such as paper or the like, a corona charger disposed inside the transfer drum at a paper supplying position for electrostatically adsorbing the transfer material onto the carrying sheet, and a conductive roller facing to the corona charger via the carrying sheet.

In the aforementioned transfer drum, as the conductive roller comes into pressure contact with the surface of the carrying film, the carrying film is depressed. As a result, when the front end of the paper supplied between the conductive roller and the carrying sheet passes through the depressed portion of the carrying sheet, the front end of the paper is peeled from the surface of the carrying sheet, resulting in a paper jam. Especially, in the case that a curved paper or a seasoned paper is used, such paper is liable to be peeled from the surface of the carrying sheet, preventing the paper to be electrostatically adsorbed onto the surface of the carrying sheet in a stable condition.

SUMMARY OF THE INVENTION

An object of the present invention is to provide a transfer device in which a paper fed to a transfer drum is electrostatically adsorbed onto the surface of the transfer without failure so that the reliability of paper passing is improved.

In order to achieve the aforementioned object, according to the first aspect of the present invention, there is provided a transfer device, comprising:

a transfer material carrying member for carrying a transfer material thereon;

an adsorption means for causing the transfer material to be adsorbed onto the surface of the transfer material carrying member at an adsorption position, the adsorption means being provided in the transfer material carrying member; and an opposite member opposite to the adsorption means, the opposite member comprising an elastic material, the opposite member movable to both a contact position with the surface of the transfer material carrying member and a separate position away from the surface of the transfer material carrying member; whereby when the transfer material positions at the adsorption position, the opposite member is switched to move to the contact position from the separate position to carry a transfer material thereon, and after the transfer material is carried, the transfer material is adsorbed on the surface of the transfer material carrying member.

In the aforementioned construction of the first aspect of the present invention, when the opposite member is moved to the contact position from the separate position, the opposite member is deformed because of its elasticity to make a wide nip portion. As the transfer material such as paper is inserted into the nip portion, the charges are sufficiently injected to the transfer material carrying member by the adsorption means, whereby transfer material is adsorbed onto the transfer material carrying member without failure so that the reliability of paper passing is improved.

Preferably, the transfer material carrying member may comprise: a pair of wheels; a dielectric film wounded between and adhered to the wheels; and an auxiliary member provided inside the dielectric film so as to come into contact with the internal surface of the dielectric film in the vicinity of the adsorption position.

Preferably, the opposite member may comprise: a shaft; a flexible member provided around the surface of the shaft; and a conductive rubber layer provided around the surface of the flexible member.

The conductive rubber layer may be grounded to the earth and may have a resistance value of $10^6$–$10^8\Omega$. The opposite member may comprise a metallic sleeve. The adsorption means may have a charge supplying device, whereby charges supplied by the charge supplying device cause the transfer material to be electrostatically adsorbed onto the surface of the transfer material carrying member.

According to the second aspect of the present invention, there is provided a transfer device, comprising:

a hollow transfer material carrying member for carrying a transfer material thereon;

an adsorption means for supplying charges to the internal surface of the transfer material carrying member to cause the transfer material to be electrostatically adsorbed onto the surface of the transfer material carrying member at an adsorption position, the adsorption means being provided in the transfer material carrying member;

an opposite member opposite to the adsorption means, the opposite member comprising an elastic material, the opposite member being movable to both a contact position with the surface of the transfer material carrying member and a separate position away from the surface of the transfer material carrying member;

an auxiliary member provided on the internal surface of the transfer material carrying member in the vicinity of the adsorption position, the auxiliary member having a plurality of openings; and a conveyance means for conveying the transfer material to the adsorption position when the auxiliary member exists at the adsorption position; whereby when the transfer material positions at the adsorption position, the opposite member is switched to move to the contact position from the separate position to carry a transfer material thereon, and after the transfer material is carried, the transfer material is adsorbed on the surface of the transfer material carrying member.

In the aforementioned construction of the first aspect of the present invention, the front end of the transfer material is inserted into the nip portion coinciding with the auxiliary member at the adsorption position. At this time, the transfer member carrying member is sufficiently reinforced at the adsorption position from inside by the auxiliary member, which eliminates the transfer member carrying member from being depressed due to the contact of the opposite member, resulting in more reliable adsorption of the front end of the transfer material.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENT

Figure 1:
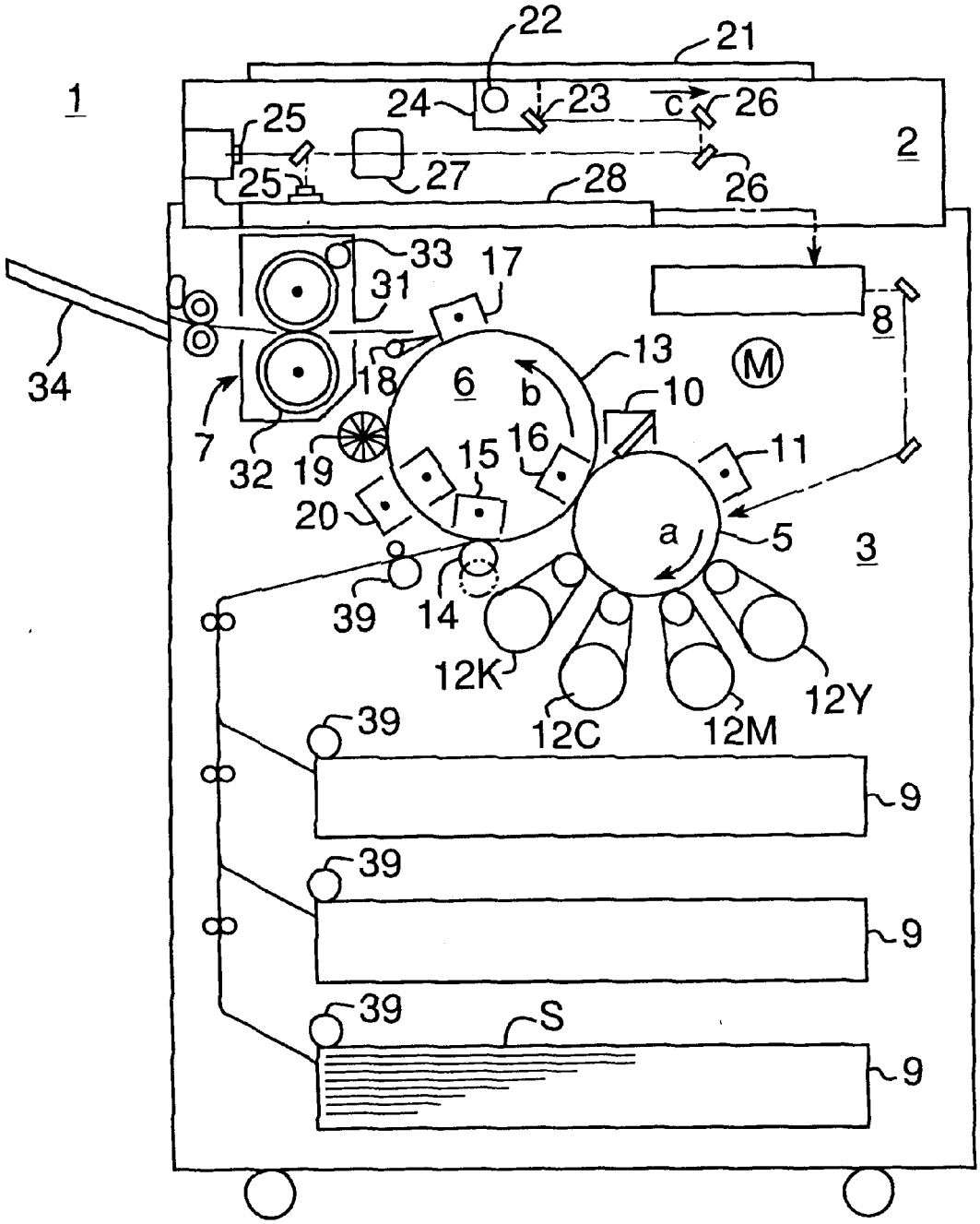
FIG. 1 is a diagramatic elevational view of a color electrophotographic copying machine employing a transfer device of a first embodiment according to the present invention.

FIG. 1 shows a color electrophotographic copying machine 1 employing a transfer device of a first embodiment according to the present invention. The color electrophotographic copying machine is comprised of an image reader portion 2 for reading out a image data of a document, a printer portion 3 for printing out the image data onto a transfer material such as paper and so on.

The image reader portion 2 has a platen glass 21 on which the document is placed, and a scanner 24 comprising an exposure lamp 22 and a mirror 23. The scanner 24 is moveable to the direction "c" (hereinafter, referred to sub-scanning direction) as shown in FIG. 1. In addition, the image reader portion 2 has CCD sensors 25 for transforming the reflecting light from the surface of the document to an electric signal and outputting it, mirrors 26 for directing the reflecting light from the surface of the document to the CCD sensors 25, a convergent lens 27 and a signal processor portion 28 for transforming the output signal from the CCD sensors 25 to a laser driving signal.

The printer portion 3 has a photosensitive drum 5 as an image carrying member disposed at the middle portion of thereof, a transfer drum 6 as a transfer material carrying member disposed opposite to the photosensitive drum 5, a fixing device 7 disposed above the transfer drum 6, a laser optical system 8 disposed above the photosensitive drum 5, and a plurality of feed paper cassettes 9 disposed under the photosensitive drum 5.

On the circumference of the photosensitive drum 5, in the rotational direction "a" as shown in FIG. 1 from the transfer drum 6, there are disposed a cleaner 10 for cleaning the surface of the photosensitive drum 5 to remove the remaining toner, an electric charger 11 for charging the photosensitive drum 5, developing devices 12Y, 12M, 12C and 12K for yellow, magenta, cyan, and black, respectively for developing a latent image formed on the photosensitive drum 5 by a laser beam irradiated from the laser optical system 8.

The transfer drum 6 is comprised of disk-like wheels (not shown) facing to each other and a cylindrical dielectric film 13 wound around and fixed to the wheels. The transfer drum 6 is rotatable in the direction "b" as shown in FIG. 1.

The transfer drum 6 includes an adsorption charger 15 as an adsorption means which supplies charges to the dielectric film 13 and causes the paper to be adsorbed on to the dielectric film 13. The adsorption charger 15 is disposed inside the dielectric film 13 at an adsorption position where a paper S is fed from any one of the feed paper cassettes 9.

Figure 2:
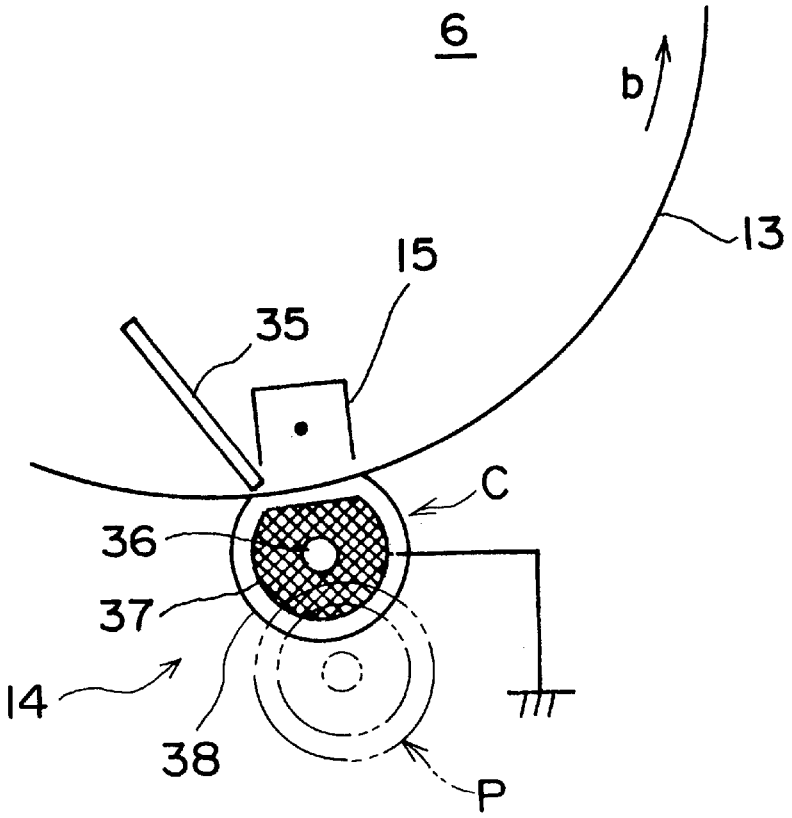
FIG. 2 is an enlarged view showing a contact portion between an adsorption roller and a transfer dram of FIG. 1.

The transfer drum 6 also includes an adsorption roller 14 disposed on the outer surface of the dielectric film 13 opposing to the adsorption charger 15 via the dielectric film 13. The adsorption roller 14 corresponds to the opposite member according to the present invention. The adsorption roller 14 is movable as shown in FIG. 2 to both a contact position (C) with the surface of the dielectric film 13 and a separate position (P) away from the surface of the dielectric film 13. At the contact position (C), the adsorption roller 14 is deformed along the outer surface of the dielectric film 13 with a predetermined nip width.

Inside the dielectric film 13, at a transfer position opposite to the photosensitive drum 5, is disposed a transfer charger 16 which causes the toner image formed on the photosensitive drum 5 to be transferred to the paper S adsorbed onto the dielectric film 13.

Moreover, along the circumference of the dielectric film 13 in the rotational direction "b" from the transfer charger 16, the transfer drum 6 includes a separation charger 17 and separation claw 18 for separating the paper S with the toner image from the surface of the dielectric film 13, an electrostatic fur blush roller 19 for cleaning the surface of the dielectric film 13 to remove the remaining toner thereon, an erasing charger 20 for erasing the charges on the dielectric film 13.

The fixing device 7 is to fix the toner image formed on the paper S separated from the transfer drum 6. The fixing device 7 is comprised of an upper roller 31 provided with a heater therein, a lower roller 32 which comes into contact with the upper roller 31, and a separation material applying unit 33 for applying separation material such as oil onto the upper roller 31 preventing the toner from adhering to the upper roller 31.

The laser optical system 8 is comprised of a laser diode which emits the laser beam in accordance with the image signal output from the signal processor portion 28 of the image reader portion 2, a collimate lens which directs the laser beam to the photosensitive drum 5, polygon mirror, F θ lens, reflection mirror and so on.

Each feed paper cassette 9 contains a number of papers S. The feed paper cassette 9 is so constructed that the paper S is separated and fed one by one toward the transfer drum 6 by means of the paper feed roller 39 when the feed paper cassette 9 is selected in response to the instruction to start copying.

FIG. 2 shows a contact portion between the adsorption roller 14 and the transfer dram 6.

As shown in FIG. 2, a backup film 35 made of dielectric material is disposed inside the dielectric film 13. One end of the backup film 35 comes into contact with the inner surface of the dielectric film 13 at the upstream side of the nip portion between the dielectric film 13 and the adsorption roller 14. The backup film 35 prevents the dielectric film 13 from being deformed due to the contact of the adsorption roller 14 to the dielectric film 13 as well as the impact when the paper S hits the dielectric film 13.

Figure 3:
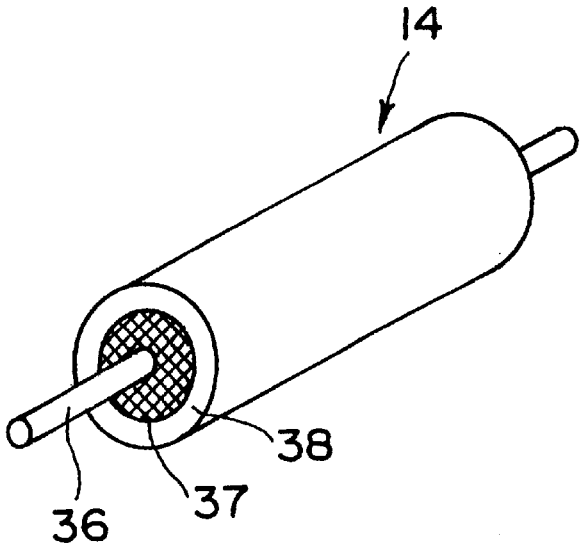
FIG. 3 is a perspective view of the adsorption roller.

FIG. 3 shows the adsorption roller 14. The adsorption roller 14 has a longitudinal length slightly shorter than that of the transfer drum 6 so that the adsorption roller 14 does not come into contact with the wheels positioned at both ends of the transfer drum 6 but comes into contact with only the dielectric film 13. The adsorption roller 14 is comprised of a shaft 36, a flexible member 37 such as sponge and so on wound around the surface of the shaft 36, and a conductive rubber layer 38 provided around the surface of the flexible member 37, whereby the adsorption roller 14 has flexibility and elasticity.

When the adsorption roller 14 comes into contact with the dielectric film 13 at the contact position (C), the adsorption roller 14 is deformed along the outer surface of the dielectric film 13 to make a nip portion. As a result, the dielectric film 13 is not locally depressed.

The material of the conductive rubber layer 38 of the adsorption roller 14 has an electric resistance value of $10^6$–$10^8\Omega$. In consideration for only the adsorptivity of the paper S onto the dielectric film 13, the electric resistance value of the conductive rubber layer 38 is preferred to be smaller. However, in this apparatus, since the distance between the adsorption position at which the paper S is adsorbed onto the dielectric film 13 and the transfer position at which the toner image is transferred to the paper S is short, the rear end of the paper S is at the adsorption position when the front end of the paper S is at the transfer position. Thus, if the electric resistance value of the conductive rubber layer 38 is small, the charges will escape through the paper S, which causes the transfer efficiency to become bad. Because of this reason, the adsorption roller 14 having an aforementioned extent of electric resistance value is used. The conductive rubber layer 38 of the adsorption roller 14 is grounded to the earth.

The copying operation of the color electrophotographic copying machine 1 having aforementioned construction will be explained below.

When the document is placed on the platen glass 21 and a print switch (not shown) is pressed on, the document is irradiated by the exposure light 22 in the image reader portion 2. The reflection light from the document passes through the mirrors 23, 26 and the convergent lens 27, creating the image on the CCD sensors 25. In this situation, the scanner 24 moves in the direction "c" (sub-scanning direction) by a drive motor to scan the all surface of the document. The reflecting light from the surface of the document is transformed to an electric signal by the CCD sensors 25, and then the electric signal is output to the signal processing portion 28.

Meanwhile, in the printer portion 3, the adsorption roller 14 is moved to the contact position (C) from the separate position (P) in accordance with the instruction from the signal processing portion 28, and a proper paper S contained in the feed paper cassette 9 is conveyed to the transfer drum 6 by means of the paper feed roller 39. As the dielectric film 13 rotates, the paper S is inserted into the nip portion with the predetermined width formed between the adsorption roller 14 and the dielectric film 13. During the paper S comes into close contact with the dielectric film at the nip portion, the charges are injected to the dielectric film 13 by the adsorption charger 15, whereby the paper S is adsorbed onto the dielectric film 13. The adsorption roller 14 is switched to move to the separation position (P) at the timing that the rear end of the paper S passes through the nip portion so as not to disturb the toner image which will be transferred onto the paper S.

Then, the photosensitive drum 5 is electrically charged by the electric charger 11 and irradiated by the laser beam from the laser optical system 8 in accordance with the laser driving signal output from the image reader portion 2, whereby a latent image is formed on the surface of the photosensitive drum 5. The latent image is visualized with the toner by means of the yellow developing device 12Y and transferred onto the paper S adsorbed on the dielectric film 13. The remaining toner is removed by the cleaner 10. Succeedingly, the photosensitive drum 5 is electrically charged again by the electric charger 11 and a magenta toner image is transferred in the aforementioned manner onto the paper S on which the yellow toner image has been transferred. Thus, a cyan toner image and a black toner image are transferred onto the paper S one after another in the same manner.

The paper S on which all of the yellow, magenta, cyan, and black image toner are transferred is separated from the dielectric film 13 by the separation charger 17 and the separaion nail 18 and conveyed to the fixing device 7. In the fixing device 7, the toner transferred on the paper S is fixed on the paper S by the heating and pressing operation. Then, the paper S is discharged on the discharge tray 34.

In the aforementioned embodiment, although the adsorption roller 14 comprising sponge material with the conductive rubber layer thereon is used, a cylindrical metallic sleeve having a thickness of 0.05 mm and elasticity may be used. In this case, if the cylindrical sleeve comprising conductive metallic material is used, the cylindrical sleeve is preferably grounded to the earth via a resistor having an electric resistance value of $10^6$–$10^8\Omega$ because of aforementioned reason.

Moreover, in the aforementioned embodiment, although the backup film 35 is disposed inside the dielectric film 13 at the nip portion between the dielectric film 13 and the adsorption roller 14, it is not necessary to provide such backup film 35 in the case that the elasticity of the adsorption roller 14 is smaller than that of the dielectric film 13.

Figure 4:
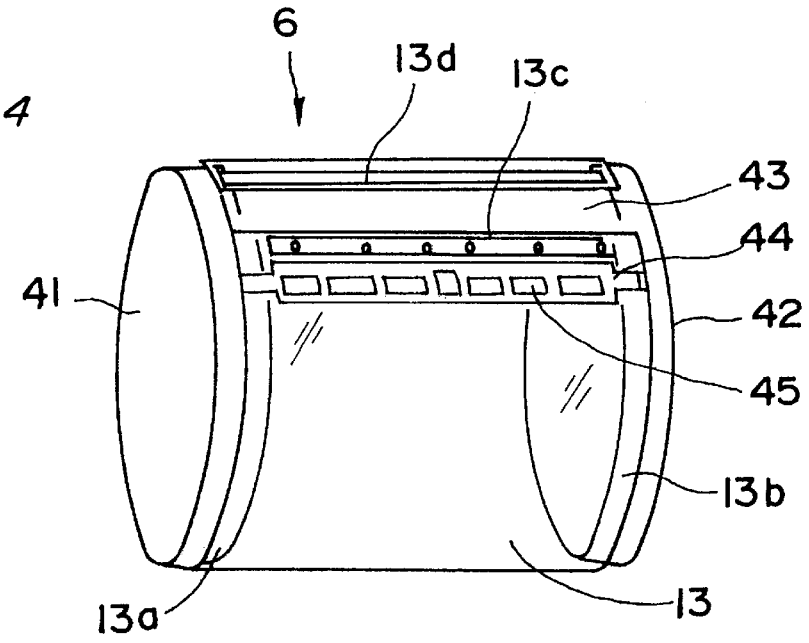
FIG. 4 is a perspective view of the transfer dram of a second embodiment according to the present invention.
Figure 5:
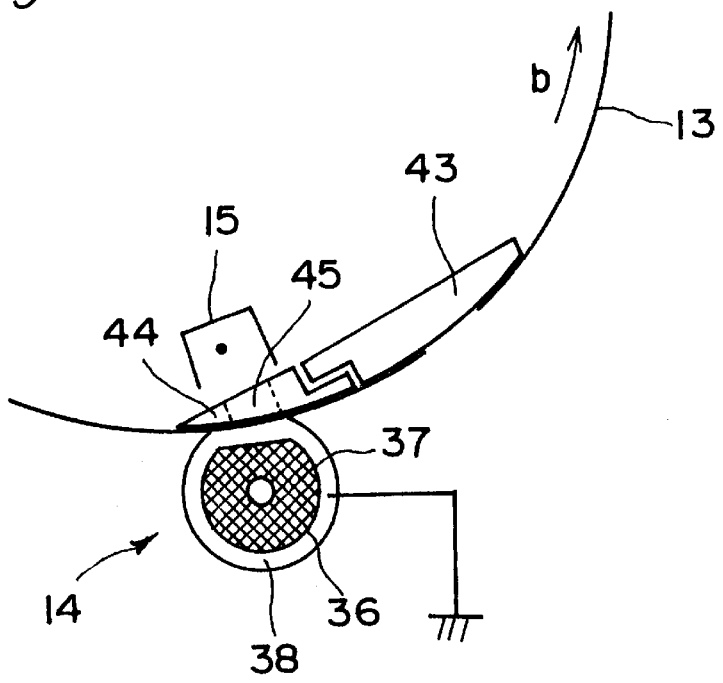
FIG. 5 is an enlarged view showing a contact portion between an adsorption roller and a transfer dram of FIG. 4.

FIGS. 4 and 5 shows a second embodiment according to the present invention.

FIG. 4 shows a transfer drum 6, and FIG. 5 shows a contact portion between the adsorption roller 14 and the transfer dram 6 corresponding to FIG. 2 of the first embodiment. Other portions are same as the first embodiment and therefore the explanation thereof is omitted.

As shown in FIG. 4, the transfer drum 6 has a framework comprising first and second disk-like wheels 41 and 42, and a connector 43. The connector 43 connects the first and second wheels 41 and 42 to make a unity body and constitutes a portion of outer surface of the transfer drum 6. The dielectric film 13 is made of transparent resin film. The both longitudinal ends 13*a* and 13*b* of the dielectric film 13 are placed on the outer periphery of the first and second wheels 41 and 42 . The dielectric film 13 is cylindrically wound so that the space between the first and second wheels 41 and 42 is enclosed. The both circumferential ends 13*c* and 13*d* are fixed to the connector 43.

As different from the first embodiment, on the downstream side of the rotational direction "b" with reference to the connector 43 of the transfer drum 6, an auxiliary member 44 according to the present invention is disposed inside the dielectric film 13 to restrain the dielectric film 13 from being depressed.

The auxiliary member 44 bridges the space between the first and second wheels 41 and 42. The auxiliary member 44 is provided with a plurality of openings 45 in the longitudinal direction so that the auxiliary member 44 looks like a ladder. The auxiliary member 44 is made of insulation material such as ceramic. However, the material of the auxiliary member 44 is not limited to ceramic and therefore resin or metal, if it is insulation material and has a certain extent of regidity, may be preferable.

In operation, when the print switch (not shown) is pressed on, the auxiliary member 44 stops at the upstream position of the rotational direction "b" with reference to the nip portion in order to adsorb and hold the paper S on the dielectric film 13. When the paper S is conveyed to the transfer drum 6 at the predetermined timing, the front end of the paper S is inserted into the nip portion coinciding with the auxiliary member 44. In the nip portion, the charges are injected to the dielectric film 13 through the openings 45 formed in a line so that the paper S is electrostatically adsorbed and hold on the dielectric film 13.

Thus, the dielectric film 13 is sufficiently reinforced at the adsorption position from inside by the auxiliary member 44, which eliminates the dielectric film 13 from being depressed due to the contact of the adsorption roller 14, resulting in reliable adsorption of the front end of the paper S. Since the front end of the paper S is reliably adsorbed and hold onto the dielectric film 13, even if an adsorption force of the other portion of the paper S is smaller, the adsorption force is increased at the transfer position by the charges from the transfer charger 16, which does not affect the conveyance of the paper S.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A transfer device, comprising:

a transfer material carrying member for carrying a transfer material thereon;

an adsorption means for causing the transfer material to be adsorbed onto the surface of the transfer material carrying member at an adsorption position, the adsorption means being provided in the transfer material carrying member; and an opposite member opposite to the adsorption means, the opposite member comprising an elastic material, the opposite member movable to both a contact position with the surface of the transfer material carrying member and a separate position away from the surface of the transfer material carrying member, the opposite member including a shaft;

a flexible member provided around the surface of the shaft, and a conductive rubber layer provided around the surface of the flexible member, wherein when the transfer material positions at the adsorption position, the opposite member is switched to move to the contact position from the separate position to carry a transfer material thereon, and after the transfer material is carried, the transfer material is adsorbed on the surface of the transfer material carrying member.

2. The transfer device as in claim 1, wherein the transfer material carrying member comprises:

a pair of wheels;

a dielectric film wound between and adhered to the wheels; and an auxiliary member provided inside the dielectric film so as to come into contact with the internal surface of the dielectric film in the vicinity of the adsorption position.

3. The transfer device as in claim 1, wherein the conductive rubber layer is grounded to the earth.

4. The transfer device as in claim 1, wherein the conductive rubber layer has a resistance value of $10^6$–$10^8\Omega$.

5. The transfer device as in claim 1, wherein the adsorption means has a charge supplying device, whereby charges supplied by the charge supplying device cause the transfer material to be electrostatically adsorbed onto the surface of the transfer material carrying member.

6. A transfer device, comprising:

a transfer material carrying member for carrying a transfer material thereon;

an adsorption means for causing the transfer material to be adsorbed onto the surface of the transfer material carrying member at an adsorption position, the adsorption means being provided in the transfer material carrying member; and an opposite member opposite to the adsorption means, the opposite member comprising an elastic material, the opposite member movable to both a contact position with the surface of the transfer material carrying member and a separate position away from the surface of the transfer material carrying member, wherein the opposite member comprises a metallic sleeve, and when the transfer material positions at the adsorption position, the opposite member is switched to move to the contact position from the separate position to carry a transfer material thereon, and after the transfer material is carried, the transfer material is adsorbed on the surface of the transfer material carrying member.

7. The transfer device as in claim 6, wherein the transfer material carrying member comprises:

a pair of wheels;

a dielectric film wound between and adhered to the wheels; and an auxiliary member provided inside the dielectric film so as to come into contact with the internal surface of the dielectric film in the vicinity of the adsorption position.

8. The transfer device as in claim 6, wherein the adsorption means has a charge supplying device, whereby charges supplied by the charge supplying device cause the transfer material to be electrostatically adsorbed onto the surface of the transfer material carrying member.

9. A transfer device, comprising:

a hollow transfer material carrying member for carrying a transfer material thereon;

an adsorption means for supplying charges to the internal surface of the transfer material carrying member to cause the transfer material to be electrostatically adsorbed onto the surface of the transfer material carrying member at an adsorption position, the adsorption means being provided in the transfer material carrying member;

an opposite member opposite to the adsorption means, the opposite member comprising an elastic material, the opposite member being movable to both a contact position with the surface of the transfer material carrying member and a separate position away from the surface of the transfer material carrying member;

an auxiliary member provided on the internal surface of the transfer material carrying member in the vicinity of the adsorption position, the auxiliary member having a plurality of openings; and a conveyance means for conveying the transfer material to the adsorption position when the auxiliary member exists at the adsorption position; whereby when the transfer material positions at the adsorption position, the opposite member is switched to move to the contact position from the separate position to carry a transfer material thereon, and after the transfer material is carried, the transfer material is adsorbed on the surface of the transfer material carrying member.

10. The transfer device as in claim 9, wherein the auxiliary member comprising an insulating material.

11. The transfer device as in claim 10, wherein the auxiliary member comprising a ceramic material.

12. The transfer device as in claim 9, wherein the transfer material carrying member comprises:

a pair of wheels;

a dielectric film wound between and adhered to the wheels; and an auxiliary member provided inside the dielectric film so as to come into contact with the internal surface of the dielectric film in the vicinity of the adsorption position.

13. The transfer device as in claim 9, wherein the opposite member comprises:

a shaft;

a flexible member provided around the surface of the shaft; and a conductive rubber layer provided around the surface of the flexible member.

14. The transfer device as in claim 13, wherein the conductive rubber layer is grounded to the earth.

15. The transfer device as in claim 14, wherein the conductive rubber layer has a resistance value of $10^6$–$10^8\Omega$.

16. A transfer device, comprising:

a hollow transfer material carrying member for carrying a transfer material thereon;

an adsorption means for supplying charges to the internal surface of the transfer material carrying member to cause the transfer material to be electrostatically adsorbed onto the surface of the transfer material carrying member at an adsorption position, the adsorption means being provided in the transfer material carrying member; and an opposite member opposite to the adsorption means, the opposite member including a shaft;

a flexible member provided around the surface of the shaft, and a conductive rubber layer provided around the surface of the flexible member, the opposite member coming into contact with the outer surface of the transfer material carrying member at the adsorption position so as to be deformed along the outer surface of the transfer material carrying member with a predetermined nip width.

17. The transfer device as in claim 16, wherein the transfer material carrying member comprises:

a pair of wheels;

a dielectric film wound between and adhered to the wheels; and an auxiliary member provided inside the dielectric film so as to come into contact with the internal surface of the dielectric film in the vicinity of the adsorption position.

18. A transfer apparatus comprising:

a transfer material carrying member for carrying a transfer material thereon:

an adsorption device for causing the transfer material to be absorbed onto the surface of the transfer material carrying member; and an elastic member comprising a shaft, a flexible member provided around the surface of the shaft, and a conductive rubber layer provided around the surface of the flexible member.

19. A transfer apparatus comprising:

a transfer material carrying member for carrying a transfer material thereon;

a rigid member provided inside of the transfer material carrying member for contracting with the transfer material carrying member at a transfer position;

an adsorption device for causing the transfer material to be adsorbed onto the surface of the transfer material carrying member; and an elastic member contacting with the outer surface of the transfer material carrying member at the transfer position, said elastic member comprising a shaft, a flexible member provided around the surface of the shaft, and a conductive rubber layer provided around the surface of the flexible member.

20. A transfer apparatus of claim 19, wherein the rigid member applies an electrical force to the transfer material carrying member.

* * * * *